United States Patent [19]

Cicin-Sain

[11] 4,080,903

[45] Mar. 28, 1978

[54] PROCESS AND APPARATUS FOR LAYING TIES FOR A RAILWAY TRACK

[75] Inventor: Yvo Cicin-Sain, Bussigny, Switzerland

[73] Assignee: Matisa Industries S.A., Lausanne, Switzerland

[21] Appl. No.: 772,232

[22] Filed: Feb. 25, 1977

[30] Foreign Application Priority Data

Mar. 5, 1976 Switzerland ..... 2748/76

[51] Int. Cl.[2] ..... E01B 29/10

[52] U.S. Cl. ..... 104/6; 221/292

[58] Field of Search ..... 104/2, 5, 6, 9; 198/459, 460, 492; 214/6 DK; 221/225, 232, 238

[56] References Cited

U.S. PATENT DOCUMENTS

| | | | |
|---|---|---|---|
| 3,335,841 | 8/1967 | Klinger et al. | 198/460 |
| 3,401,832 | 9/1968 | Cremieux | 221/225 |
| 3,604,358 | 9/1971 | Plasser et al. | 104/6 |
| 3,638,577 | 2/1972 | Plasser et al. | 104/6 |
| 3,645,209 | 2/1972 | Von Beckmann | 104/6 |
| 3,691,957 | 9/1972 | Plasser et al. | 104/9 |
| 3,701,320 | 10/1972 | Fearon et al. | 104/6 |
| 3,877,384 | 4/1975 | Fearon et al. | 104/9 |

*Primary Examiner*—Drayton E. Hoffman
*Assistant Examiner*—Carl Rowold
*Attorney, Agent, or Firm*—Wenderoth, Lind & Ponack

[57] ABSTRACT

The invention is a method of and apparatus for continuously laying sleepers at permanent positions at predetermined intervals on a bed of ballast for a railway track, by means of a vehicle travelling along the track, which method comprises feeding each sleeper in turn from a stock of sleepers to a laying mechanism where the sleeper is held a little above the level of the bed of ballast, removing vertical support from beneath the sleeper at a position in advance of the intended permanent position of the sleeper so that the sleeper falls onto the bed of ballast in advance of its intended permanent position, drawing the sleeper along the bed of ballast until it reaches its intended permanent position and then completely releasing the sleeper in its intended permanent position. The invention permits the sleepers to be laid with greater accuracy than when using prior apparatus.

9 Claims, 7 Drawing Figures

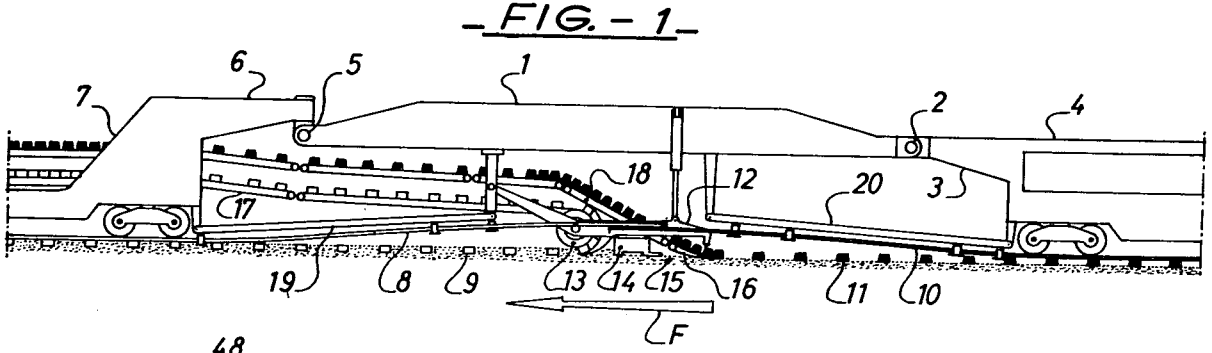
-FIG.-1-
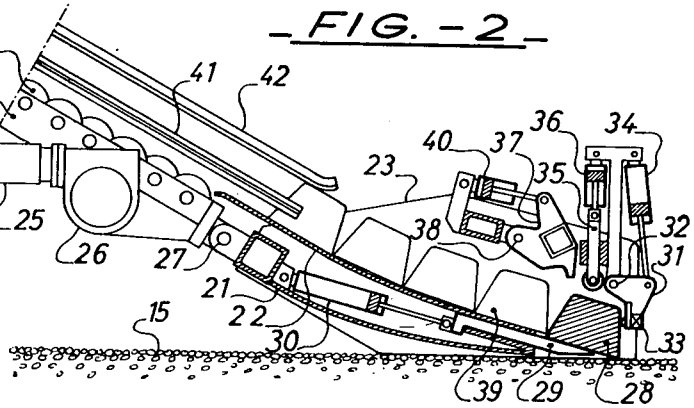
-FIG.-2-
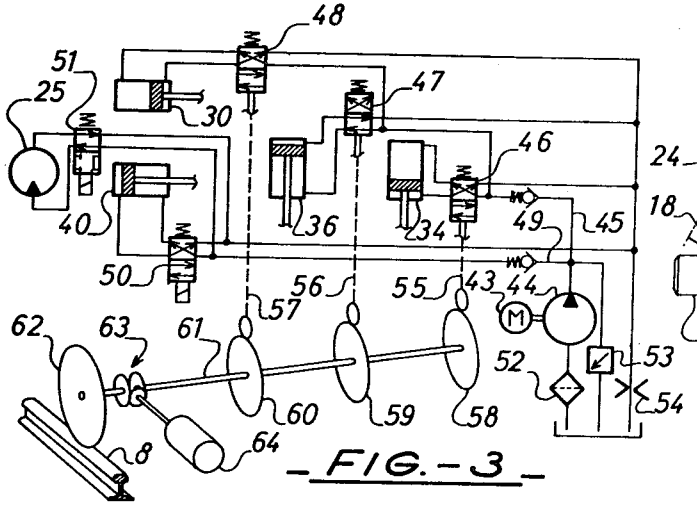
-FIG.-3-

PROCESS AND APPARATUS FOR LAYING TIES FOR A RAILWAY TRACK

FIELD OF THE INVENTION

The present invention has for its subject a method and an apparatus for laying sleepers, or ties, at predetermined intervals and in prescribed alignment, on the bed of ballast of a railway track.

DESCRIPTION OF THE PRIOR ART

There are already known processes of this type which consist in laying the sleepers, also known as ties at predetermined intervals as a function of the distance travelled by a works vehicle over the laying positions. In this vehicle, one supplies the sleepers from a stockpile up to a laying point where one brings and retains successively each sleeper to be laid a little above the level of the bed of ballast at the prescribed alignment and where it is freed at the desired moment so that it falls at the prescribed interval.

These processes are satisfactory in the situation where accuracy is not required in the respect of prescribed intervals. In fact, the sleepers in falling do not stabilize themselves immediately at the moment of the arrival on the bed of ballast. This emerges from the fact that the impact is produced in accordance with an oblique trajectory, - resultant from the combination of the speed of the vertical fall of the sleeper and of the speed of advance of the laying vehicle, - on a bed of ballast the state of the surface of which does not necessarily present the same characteristics of flatness and resistance from one sleeper to another. This phenomenon causes irregularities in the intervals between the laid sleepers and it is necessary to correct them manually when these irregularities exceed tolerable limits.

Moreover, at the moment of impact, it is very rare that the sleeper encounters the bed of ballast at the same time over the whole of its length, which has the effect that it stops slightly obliquely, the end which enters into contact with the ballast first becoming settled more quickly than the other. Here likewise, it can become necessary to correct their position manually.

The process and the device of laying of the present invention have for their object to remedy these inconveniences in ensuring the laying of the sleepers with a precision which is sufficient to avoid all further need for manual correction of the position of the laid sleepers.

SUMMARY OF THE INVENTION

According to one aspect of the present invention there is provided a method of continuously laying sleepers at permanent positions at predetermined intervals on a bed of ballast for a railway track, by means of a vehicle travelling along the track, which method comprises feeding each sleeper in turn from a stock of sleepers to a laying mechanism where the sleeper is held a little above the level of the bed of ballast, removing vertical support from beneath the sleeper at a position in advance of the intended permanent position of the sleeper so that the sleeper falls onto the bed of ballast in advance of its intended permanent position, drawing the sleeper along the bed of ballast until it reaches its intended permanent position and then completely releasing the sleeper in its intended permanent position.

According to a further aspect of the invention there is provided apparatus for continuously laying sleepers at permanent positions at predetermined intervals on a bed of ballast for a railway track, which apparatus comprises a vehicle provided with a laying mechanism for holding a sleeper a little above the level of the bed of ballast, the laying mechanism including a retractable vertical support which when retracted permits the sleeper to fall onto the bed of ballast, a displaceable stop which in operation draws the sleeper along the bed of ballast until the stop is displaced to release the sleeper in the intended permanent position of the sleeper, a conveyor for conveying sleeper in turn from a stock of sleepers to the laying mechanism and a control circuit responsive to the distance travelled by the vehicle for controlling the sequence of operations of the retractable vertical support and the displaceable stop to lay the sleeper at the predetermined intervals.

Thanks to this process, the sleepers are laid with great precision by the fact that these are no longer freed in an unstable bouncing condition due to their fall, the effects of which are uncontrollable, but are released after stabilization of this phenomenon at the precise moment when they arrive at the prescribed position.

DESCRIPTION OF THE PREFERRED EMBODIMENTS

It is advantageous to complete the action of releasing the sleeper in its prescribed position by the application of a vertical pressure on the sleeper, which has the effect of securing it in position by slight anchoring in the ballast.

This complementary operation presents the advantage of not risking leaving the sleeper posed on several pebbles above the level of the bed of ballast, thus in an unstable position.

The control circuit preferably includes a sequential regulating member controlled according to the distance travelled.

For the application of a vertical pressure onto the sleeper to be laid, this device preferably comprises, in addition to the support and stop members, at least one vertically acting ram disposed at the fulcrum of the said sleeper to be laid and actuated by a motor member controlled by the control circuit; the sequential regulating member of the said circuit being adjusted so that the said ram operates after the withdrawal of the support member.

Preferably the control circuit also controls the operation of the conveyor to supply the sleepers from the stock to the laying mechanism.

In a preferred form of the apparatus, the retractable support member for the sleeper in which the retractable support member for the sleeper to be laid comprises two retractable tongues extending from the end of the laying mechanism and disposed one on each side of the axis of symmetry of the sleepers. It is also preferred that the displaceable stop for the sleeper to be laid comprises two pivotable stops one disposed on each side of the axis of symmetry of the sleeper the pivotal axis of which is parallel to the longitudinal axis of the sleeper and is situated above the sleeper, and the end of the stops is in contact, in the retaining position, with the back face of the sleeper with respect to the direction of advance of the laying apparatus.

There may also be a retaining system for the feed of sleepers to the laying mechanism controlled by the control circuit, and the displaceable stop for the sleeper to be laid includes a contact on its contact face and connected with the said control circuit to control the supply of sleepers during the laying operation.

DESCRIPTION WITH REFERENCE TO THE DRAWINGS

The present invention will be described further, with reference to the accompanying drawings showing by way of example one embodiment of the invention, in which:

FIG. 1 shows a simplified representation of a renewal train for railway tracks provided with a laying device in accordance with the invention;

FIG. 2 is a detailed view of part of the laying device;

FIG. 3 is a diagram of the feed and control circuit of the laying device; and

Figure 4:
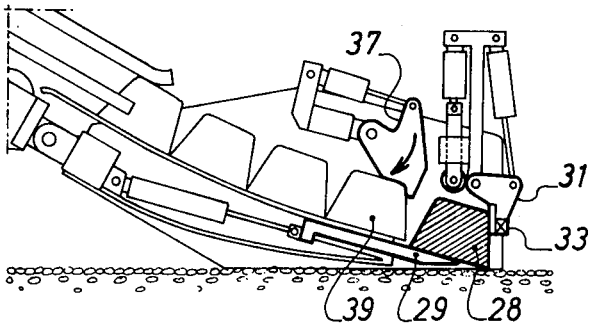
FIGS. 4, 5, 6 and 7 show the steps of the operation of laying of a sleeper.

The renewal train shown in its basic features in FIG. 1 is similar to that described in Swiss Pat. No. 511,332.

This train includes a beam 1 pivoted at one end 2 on a bracket 3 of a locomotive 4 partially shown, and supported at the other end 5 on a bracket 6 of a sleeper stock wagon 7.

This train travels from right to left as shown, in accordance with the arrow F, the stock wagon 7 riding on the rails 8 of an old track and the sleepers 9 to be changed and the locomotive 4 riding on the rails 10 of the new track and the new sleepers 11.

On the beam 1, mounted on a framework 12, is a pick-up device 13 for the old sleepers 9, a regulating device 14 for levelling the ballast 15 and a laying device 16 for new sleepers 11. A system of conveyors 17 and 18 connect the laying and pick-up devices 16 and 13 to the stock wagon 7.

As the train moves forward, the old rails 8 are lifted and swung clear by a guiding device 19, the old sleepers 9 are picked up and replaced by the new sleepers 11 which are laid on a flattened and levelled bed of ballast 15 and the new rails 10, previously laid on each side of the old track are lifted and brought towards each other and then laid at the normal distance apart on the new sleepers 11 by a guiding device 20.

The laying device 16, shown in detail in FIG. 2, comprises a hollow structure formed by two concave metal sheets 21 and 22 and having two outer vertical flanges parallel to the direction of the track, only one of which, the flange 23, is visible in the drawing. The upper concave metal sheet 22, for the final guiding of the sleepers 11 to be laid, is an extension of the rolling plane of the conveyor 18, of which the rollers 24, the motor 25 and reducer 26 traction assembly are shown. This hollow structure, on which is mounted the laying mechanism proper, is connected at the end of the conveyor 18 by a pivot 27 and to the framework 12 (FIG. 1) by suspension jacks, not shown in FIG. 2, permitting the adjustment of its height with respect to the bed of ballast 15 and for lifting the apparatus for light running.

The laying mechanism comprises two sets of laying equipment disposed on both sides of the centre axis of the sleepers between the two vertical flanges. The mechanism includes a retractable support tongue 29 for the new sleepers 11 to be laid, such as the sleeper 28, which tongue can be withdrawn into the space beneath the concave metal sheet 22, by a hydraulic jack 30.

A first retractable retaining member in the form of a pivotal stop 31 is provided, the pivotal axis 32 of which is situated above the sleeper 28 to be laid. The end of the stop 31 is provided with a contact 33, and in the retaining position, is in contact with the rear face of the sleeper 28. This stop 31 is actuated by a hydraulic jack 34.

A pressure part consituted by a vertically acting hydraulic ram 35 is disposed above the fulcrum of the sleeper 28 to be laid, actuated by a hydraulic jack 36. A second retractable retaining part is provided which is constituted by a retaining member 37 the pivotal axis 38 of which is situated above the next sleeper 39 to be laid, and actuated by a hydraulic jack 40. Slides 41 and 42 for guiding the sleepers during their journey on the conveyor 18 are provided.

The hydraulic control jacks of these parts of the sleeper laying mechanism, as well as the hydraulic motor of the conveyor 18, are connected to a feed and control circuit shown in FIG. 3.

A motor 43, for example an electric motor, drives a hydraulic pump 44. This pump 44 feeds, by a first branch circuit 45, the three control jacks 34, 36 and 30 of the stop 31, the ram 35 and the tongue 29 respectively by mechanically controlled four way valves 46, 47 and 48. This pump 44 likewise feeds by a second branch circuit 49 the hydraulic control jack 40 of the retaining member 37 by a four way electromechanical valve 50 and the hydraulic motor 25 of the conveyor 18 by a two way electromechanical valve 51. The hydraulic circuit comprises in usual manner a filter 52, a discharge valve 53, a choke 54 and non-return valves.

The valves 50 and 51 are controlled by the contact 33 on the stop 31 (FIG. 2) and the valves 46, 47 and 48 by pusher rods 55, 56 and 57 respectively actuated by cams 58, 59 and 60 respectively mounted on a shaft 61. This cam shaft 61 is connected to a wheel 62 maintained in permanent contact, during the laying operation, with a rail of the track, for example the rail 8. This wheel 62 is selected to be of a circumferential length equal to the length of sleeper spacing. A differential 63 is mounted on the shaft 61 on which a motor 64 operates to permit the return-to-zero of the cams whenever necessary.

This mechanical control of the distributors 46, 47 and 48 permits the laying of the sleepers at regular intervals corresponding to the length of the track as a function of the path traversed by the laying train.

The laying operation of each sleeper unfolds by successive stages shown by the progress of FIGS. 2, 4, 5, 6 and 7.

So as not to unnecessarily complicate the description of these stages, they will only be described for one of the two sets of laying equipment of the laying mechanism.

In FIG. 2, the retaining member 37 and the ram 35 are lifted, the stop 31 is lowered into the retaining position and the tongue 29 extends to support position the sleeper 28 to be laid. The conveyor 18 operates and feeds the laying mechanism. At a precise moment of this first stage, the first sleeper 28 comes into contact with the contact 33. The feed and control circuit is at this time in the state shown in FIG. 3.

In FIG. 4, the sleeper 28 having operated the contact 33 is in abutment with the stop 31. The contact 33 directly controls the changeover of the position of the valves 50 and 51, thus stopping the motor 25 of the conveyor 18 and lowering the retaining member 37 on to the next sleeper 39.

At this moment, the sleeper 28, supported on the tongue 29 and retained by the stop 31, is ready for the laying operation proper.

Figure 5:
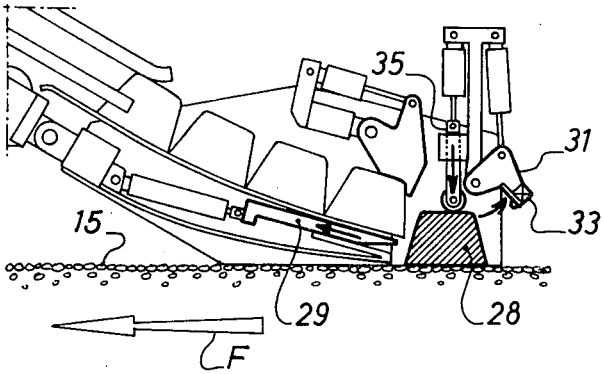

This laying operation is shown in FIG. 5, wherein just before the sleeper 28 arrives in the desired position determined by the wheel 62 (FIG. 3), the cam 60 operates the pusher 57 and switches the valve 48 to cause the retraction of the support tongue 29. The sleeper 28 then settles on the bed of ballast 15 whilst continuing to be drawn along with the forward movement of the train in accordance with the arrow F, by the stop 31.

When the sleeper 28 arrives in the desired position determined by the wheel 62 (FIG. 3), the cam 58 operates the pusher 55 and changes the position of the valve 46, thus causing the raising of the stop 31. Simultaneously, pressure is applied by the ram 35 to the upper face of the sleeper 28, the ram 35 being controlled by the action of the cam 59 (FIG. 3) and its pusher 56 on the changeover valve 47.

At this moment the sleeper 28 is exactly in the prescribed position after stabilization of the rebounding phenomenon which tends to accompany the drop of the sleeper and is fixed in this position regardless of irregularities in the surface of the bed of ballast 15.

Figure 6:
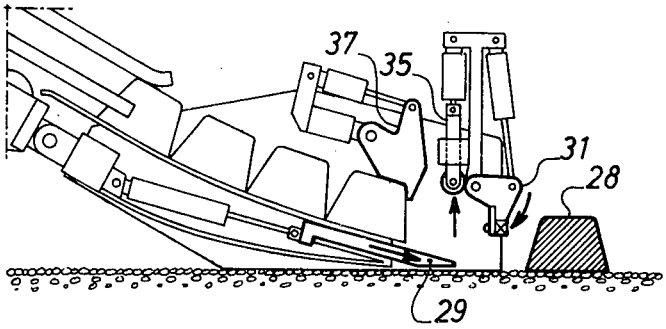
Figure 7:
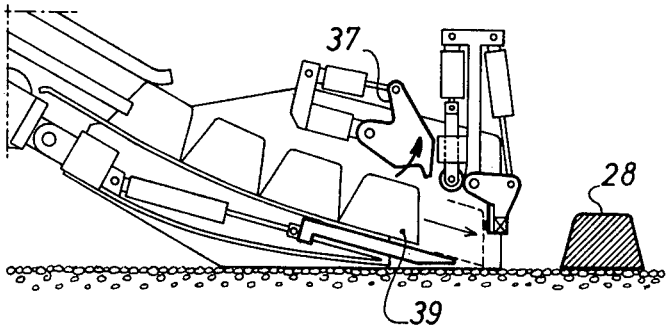

Finally, the contact 33 is freed of the pressure of the sleeper 28 at the moment of the raising of the stop 31, which has the effect of exciting a delay relay mounted in the circuit connecting the contact 33 with the electromechanical valves 50 and 51 which control the conveyor motor 25 and the retaining member 37 so as to actuate them after the subsequent stage shown in FIG. 6.

In FIG. 6, the stop 31 is relowered. The pusher 35 is raised and the tongue 29 is extended by the simultaneous actions of the cams 58, 59 and 60 on the valves 46, 47 and 48 as soon as the stop 31 disengages the laid sleeper 28 and all these valves return to the position shown in FIG. 3. The retaining member 37 and the motor 25 of the conveyor 18 are operated in the last stage shown in FIG. 7, immediately after the closure of the contacts of the delay relay previously excited by the contact 33.

At this moment, the laying mechanism and its control circuit are in the state shown in FIGS. 2 and 3 with the only difference that the sleeper 28 has been replaced by the subsequent sleeper 39, and the same cycle of operations restarts for this sleeper and similarly for each of the subsequent sleepers on the stock wagon 7.

The time intervals separating each operation from the subsequent one are determined as a function of the distance between each of them in taking account the travel and the transverse gauge of the sleepers on the right of the parts which operate on them, so as to ensure the free functioning of these parts. These time intervals would be also adpated to the length of time of the rebounding of the sleepers after their drop, which depends in turn on their weight, their elasticity, and their height of drop, so as to ensure the maximum precision which one can attain of the laying process in accordance with the invention.

The application of the laying process for the sleepers in accordance with the invention is not limited to the renewal of permanent ways given by way of example, but on the contrary extends to all operations necessitating the laying of sleepers at regular intervals on a bed of ballast of permanent ways.

What I claim as my invention is:

1. A method of continuously laying sleepers at permanent positions at predetermined intervals on a bed of ballast for a railway track, by means of a vehicle travelling along the track, which method comprises feeding each sleeper in turn from a stock of sleepers to a laying mechanism where the sleeper is held a little above the level of the bed of ballast, removing vertical support from beneath the sleeper at a position in advance of the intended permanent position of the sleeper so that the sleeper falls onto the bed ballast in advance of its intended permanent position, drawing the sleeper along the bed of ballast until it reaches its intended permanent position and then completely releasing the sleeper in its intended permanent position.

2. A process as claimed in claim 1, wherein after the sleeper has been released, a vertical pressure is applied to it to anchor it in the ballast in its predetermined position.

3. Apparatus for continuously laying sleepers at permanent positions at predetermined intervals on a bed of ballast for a railway track, which apparatus comprises a vehicle provided with a laying mechanism for holding a sleeper a little above the level of the bed of ballast, the laying mechanism including a retractable vertical support which when retracted permits the sleeper to fall onto the bed of ballast, a displaceable stop which in operation draws the sleeper along the bed of ballast until the stop is displaced to release the sleeper in the intended permanent position of the sleeper, a conveyor for conveying sleepers in turn from a stock of sleepers to the laying mechanism and a control circuit responsive to the distance travelled by the vehicle for controlling the sequence of operations of the retractable vertical support and the displaceable stop to lay the sleepers at the predetermined intervals.

4. Apparatus as claimed in claim 3 wherein the control circuit includes a sequential regulating member controlled according to the distance travelled.

5. Apparatus as claimed in claim 3 wherein the control circuit also controls the operation of the conveyor.

6. An apparatus for laying sleepers as claimed in claim 4, in which the laying mechanism includes at least one vertically acting ram disposed at the fulcrum of the sleeper to be laid and actuated by a motor member controlled by the control circuit, the sequential regulating member of the said circuit being adjusted so that the ram operates after the withdrawal of the support member.

7. An apparatus for laying sleepers as claimed in claim 3, in which the retractable support member for the sleeper to be laid comprises two retractable tongues extending from the end of the laying mechanism and disposed one on each side of the axis of symmetry of the sleepers.

8. An apparatus for laying sleepers as claimed in claim 3 in which the displaceable stop for the sleeper to be laid comprises two pivotable stops one disposed on each side of the axis of symmetry of the sleeper the pivotal axis of which is parallel to the longitudinal axis of the sleeper and is situated above the sleeper, and the end of the stops is in contact, in the retaining position, with the back face of the sleeper with respect to the direction of advance of the laying apparatus.

9. An apparatus for laying sleepers as claimed in claim 3, in which there is provided a retaining system for the feed of sleepers to the laying mechanism controlled by the control circuit, and the displaceable stop for the sleeper to be laid includes a contact on its contact face and connected with the said control circuit to control the supply of the sleepers during the laying operation.

* * * * *